US005520303A

United States Patent [19]

Bernstein et al.

[11] Patent Number: 5,520,303

[45] **Date of Patent: *May 28, 1996**

[54] DIAPER PAIL

[75] Inventors: Michael S. Bernstein, Natick; Brian C. Sundberg, Stoughton, both of Mass.; David W. Crossley, Woonsocket, R.I.

[73] Assignee: Safety 1st, Inc., Chestnut Hill, Mass.

[ * ] Notice: The term of this patent shall not extend beyond the expiration date of Pat. No. 5,385,259

[21] Appl. No.: 380,499

[22] Filed: Jan. 30, 1995

Related U.S. Application Data

[63] Continuation of Ser. No. 188,081, Jan. 28, 1994, Pat. No. 5,385,259.

[51] Int. Cl.[6] ..... B65D 43/00

[52] U.S. Cl. ..... 220/404; 220/908; 4/452

[58] Field of Search ..... 220/404, 908, 220/522; 4/452

[56] References Cited

U.S. PATENT DOCUMENTS

| | | | |
|---|---|---|---|
| 2,352,503 | 6/1994 | Walton | 220/404 X |
| 3,321,103 | 5/1967 | Phillips | 220/404 |
| 3,771,493 | 11/1973 | Chandor | 4/452 |
| 3,779,419 | 12/1973 | Heitz | 220/404 |
| 4,917,263 | 4/1990 | Korb | 220/404 |
| 5,125,526 | 6/1992 | Sumanis | 220/404 X |
| 5,174,462 | 12/1992 | Hames | 220/908 X |
| 5,385,259 | 1/1995 | Bernstein et al. | 220/404 |

*Primary Examiner*—Steven M. Pollard
*Attorney, Agent, or Firm*—Wolf, Greenfield & Sacks

[57] ABSTRACT

The diaper pail assembly includes a pail, a ring rotatably mounted on the mouth of the pail and a cover connected to the ring. A disposable trash bag lines the pail and the mouth of the trash bag overlaps the ring and is grasped between the cover and ring. By turning the cover and ring, the trash bag is twisted closed. A chute in the cover through which soiled diapers are placed in the pail has inner and outer lids to close the chute.

8 Claims, 10 Drawing Sheets

DIAPER PAIL

This application is a continuation of application Ser. No. 08/188,081 filed Jan. 28, 1994, now U.S. Pat. No. 5,385,259.

BACKGROUND OF THE INVENTION

This invention relates to diaper pails and more particularly comprises a new and improved diaper pail specifically designed to be used with a disposable liner such as a conventional disposable trash bag and enables the trash bag liner to be twisted closed before removal from the pail and which prevents unpleasant odors from escaping from the pail when soiled diapers are in it.

A variety of different diaper pails are available for use in the home for the disposal of soiled diapers. Many of them have lids that are pivotally mounted on the pail and employ foot pedal actuators to open them. Conventionally, liners are used in the pails and to place a soiled diaper in the pail or remove the liner from the pail the foot pedal is depressed so as to open the lid. Ordinarily before the liner is disposed of with the soiled diapers, the mouth of the liner is twisted closed. Handling the open liner to twist it closed is an unpleasant task. Furthermore, in the typical diaper pails described above, when the cover is opened by the foot pedal, the contents of the bag is exposed and odors from the bag liner may escape from the pail.

In an effort to improve upon the typical diaper pails described, diaper pails have been developed that include means for automatically twisting the bags closed. In Sumanis U.S. Pat. No. 5,125,526 a waste receptacle is disclosed wherein an inner trash bag holder is rotatably mounted in the pail and the rim of the liner is fixed. A foot pedal actuator is connected to the lid of the pail and to the holder, and when the foot pedal is depressed, the holder is rotated to twist the bag closed and simultaneously the lid of the pail is opened. In Richards et al. U.S. Pat. No. 4,869,049, a special tube of plastic film is used in the pail, and a special mechanism is provided for twisting the tube closed after each soiled diaper is deposited in it. An elaborate system is employed for feeding the tubular plastic liner material into the pail proper. While these diaper pails provide improved results over the conventional pails described above, they are not altogether satisfactory. The diaper pail shown in the '049 patent requires the use of special tubular plastic lining material and is relatively expensive to manufacture. The waste receptacle of the '526 patent is susceptible to breakage because of the number of moving parts and the levers connecting the rotatable holder with the tiltable lid.

The principle object of the present invention is to provide a relatively simple diaper pail that may be manufactured inexpensively and that automatically twists the liner closed before the liner with the soiled diapers is to be removed from the pail.

Another important object of the present invention is to provide a diaper pail that has a special chute in the cover with lids at each end, which provides a double barrier for odors that would otherwise escape from the pail.

Another important object of the present invention is to provide a diaper pail that has a "child proof" latch for controlling access to the interior of the pail and which will retain the pail in the closed condition so that its contents cannot spill out even if the pail is knocked over or inverted.

Yet another object of the present invention is to provide a deodorant basket in the cover of the pail which may be removed and refilled without opening the main cover of the pail.

Yet another object of the present invention is to provide an automatic flip-type lid which will open upon release of its latch so that ready access is provided to the interior of the pail for the person disposing of a diaper.

To accomplish these and other objects, the diaper pail assembly of the present invention includes a pail open at the top and which carries a rotatable ring at the top over which the mouth of a conventional trash bag may be draped when the bag is placed in the pail as a liner. A cover is attached to the ring and when closed pinches the mouth of the trash bag liner against the ring. The ring and cover may be turned on the pail as a unit, which causes the mouth of the liner inside the pail to twist closed. Thereafter, the cover may be opened and the twisted closed liner may be tied and removed from the pail.

Access to the trash bag liner in the pail for disposing of diapers is provided through a chute formed in the cover. The chute is provided with lids at its top and bottom ends. The lid at the top is biased to the open position but may be latched closed by a "child proof" latch lock assembly, and the lid at the lower end of the chute is biased to the closed position so as to prevent odors from escaping from the liner, generated by the soiled diapers in it. A separate deodorant basket is provided in the cover, which may be removed without opening the cover, so that the deodorant supply may be most conveniently replenished.

These and other objects and features of the present invention will be better understood and appreciated from the following detailed description of one embodiment thereof selected for purposes of illustration and shown in the accompanying drawing.

BRIEF FIGURE DESCRIPTION

Figure 3:
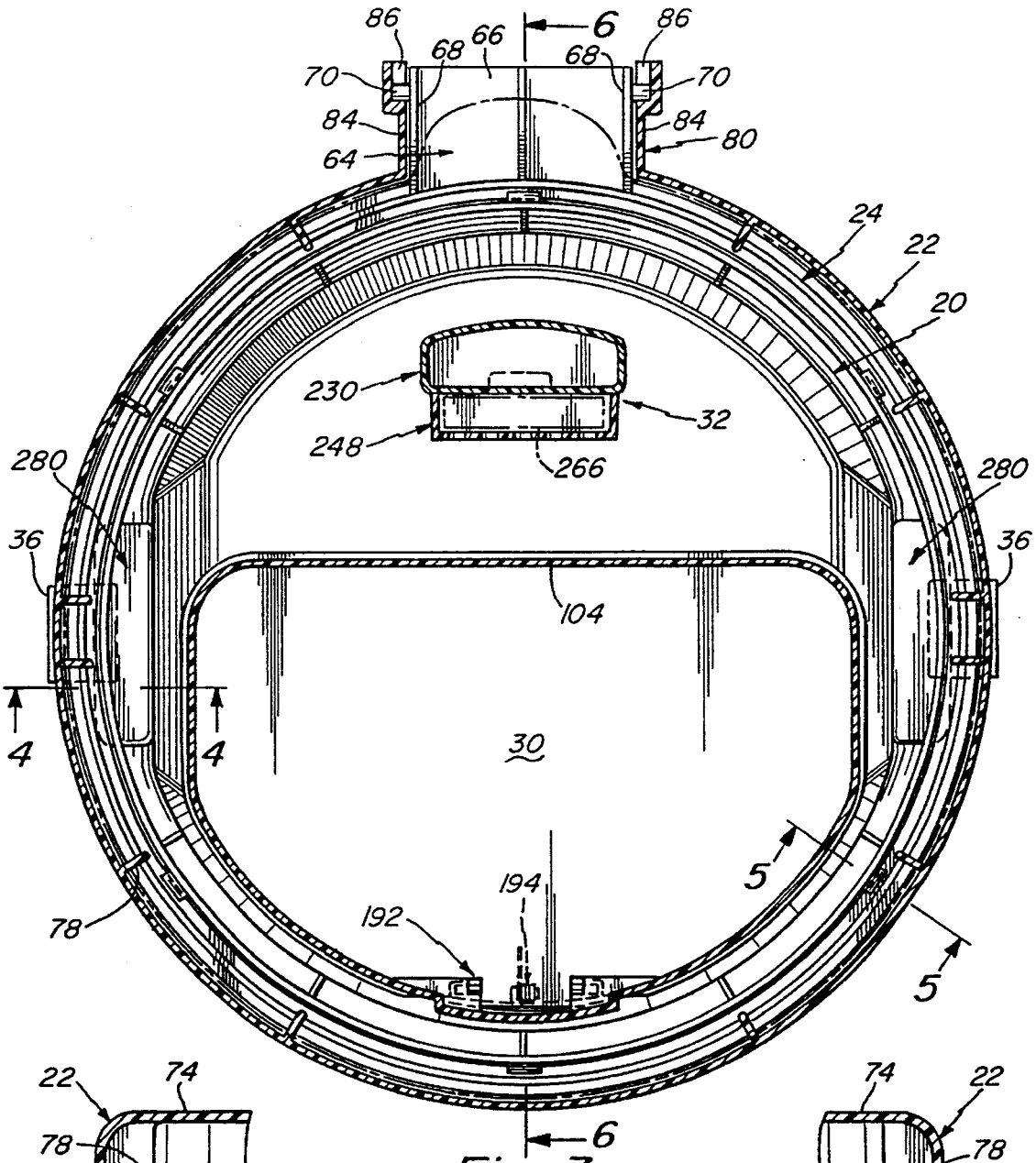
FIG. 3 is a horizontal cross sectional view taken along the section line 3—3 in FIG. 2.
Figure 4:
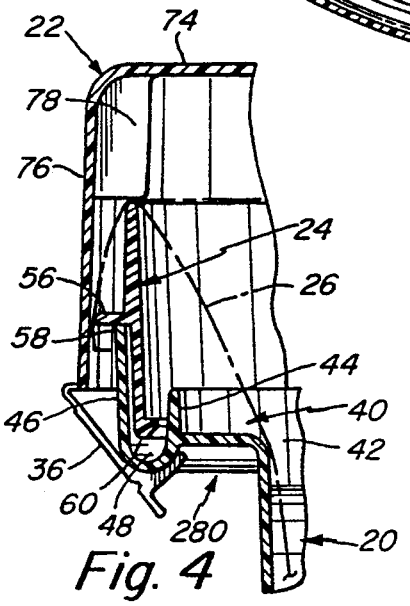
Figure 5:
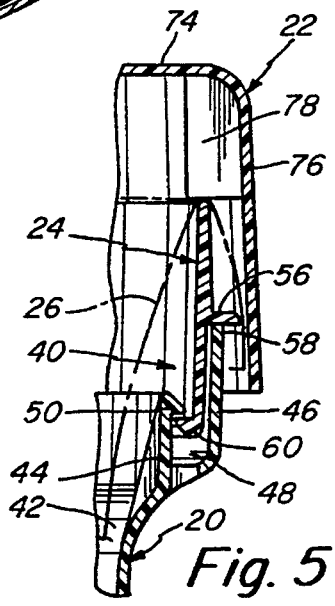
Figure 6:
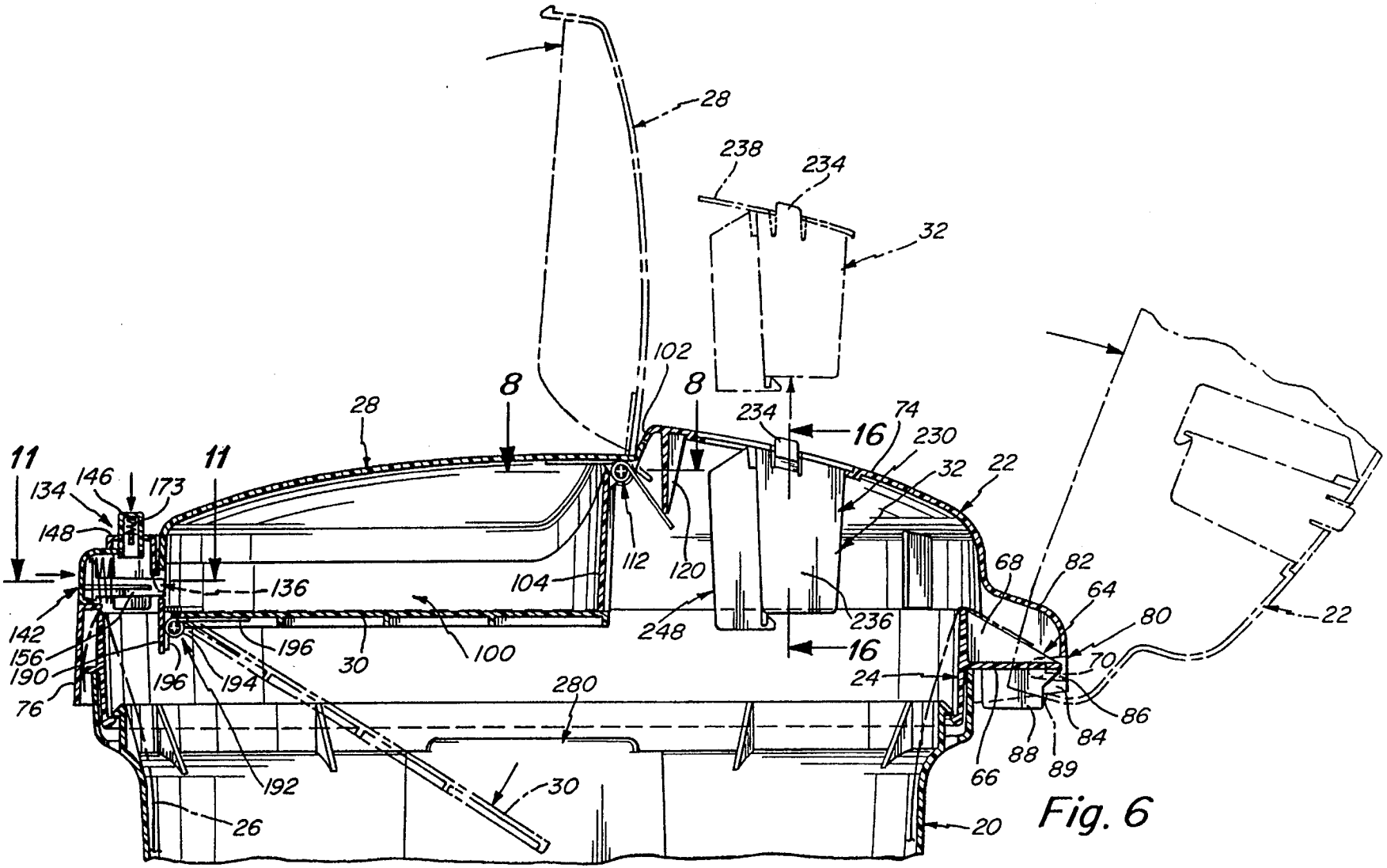
Figure 7:
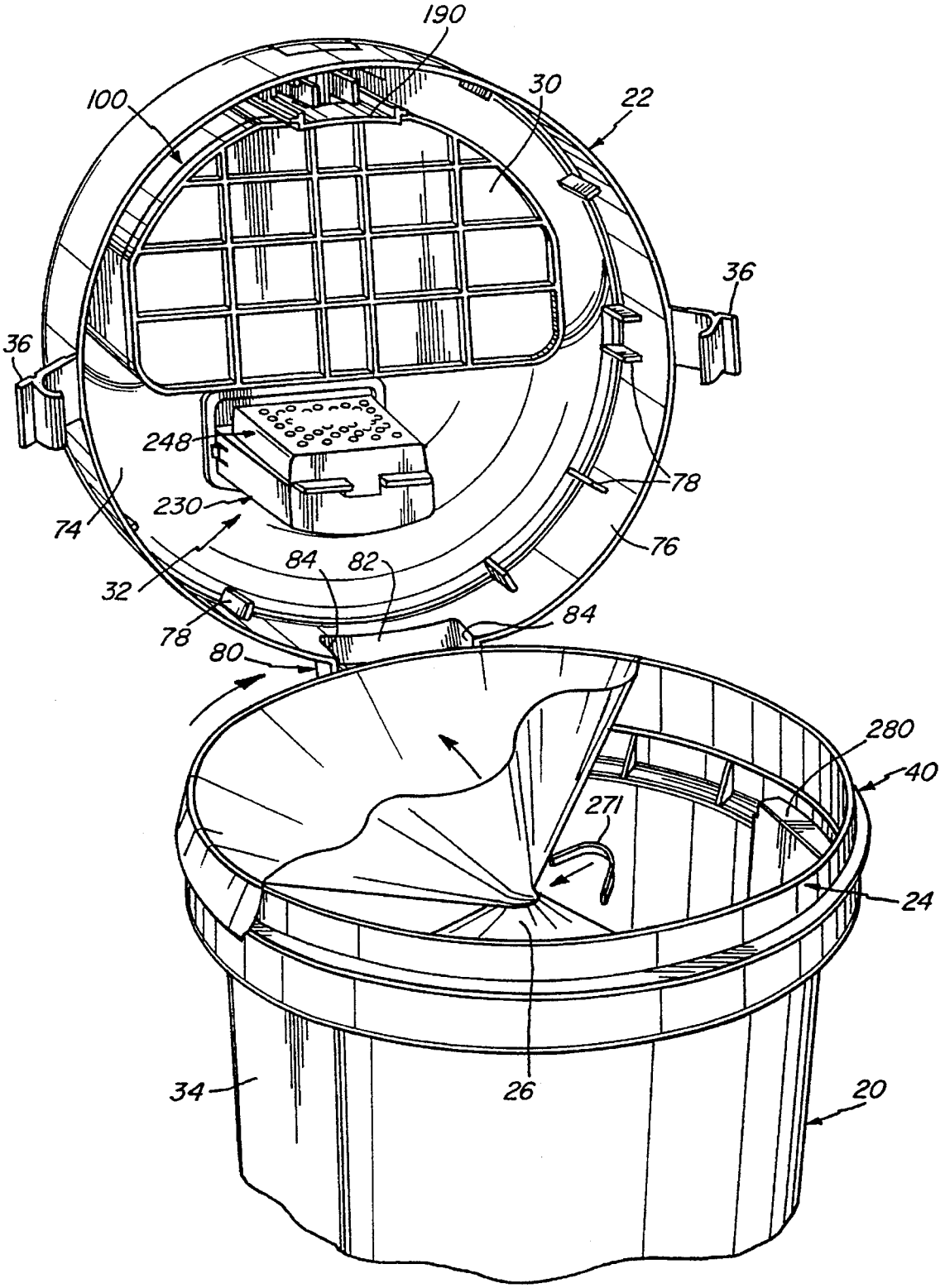
Figure 8:
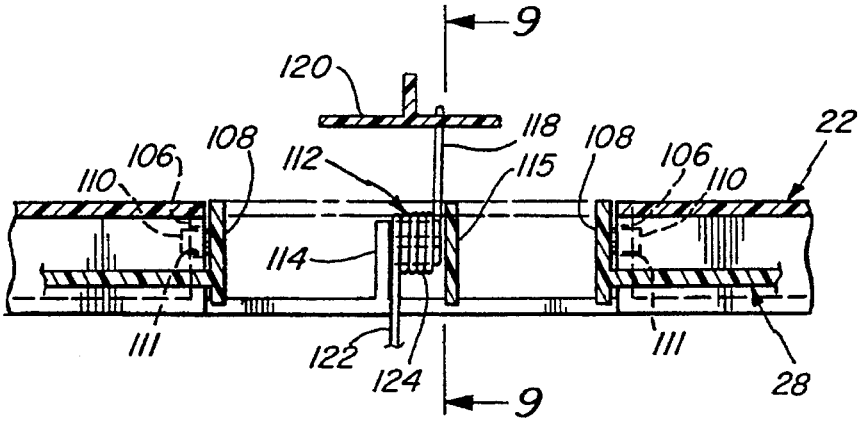
Figure 9:
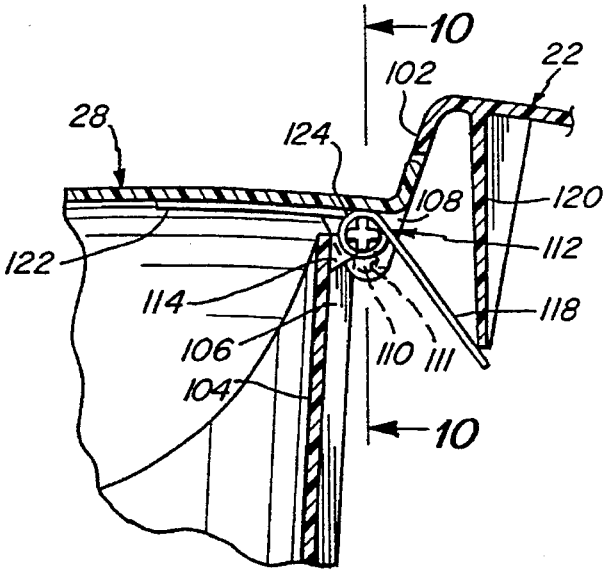
Figure 10:
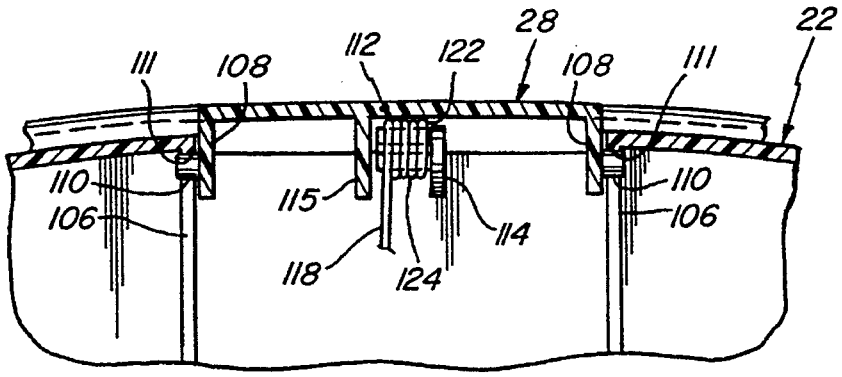
Figure 11:
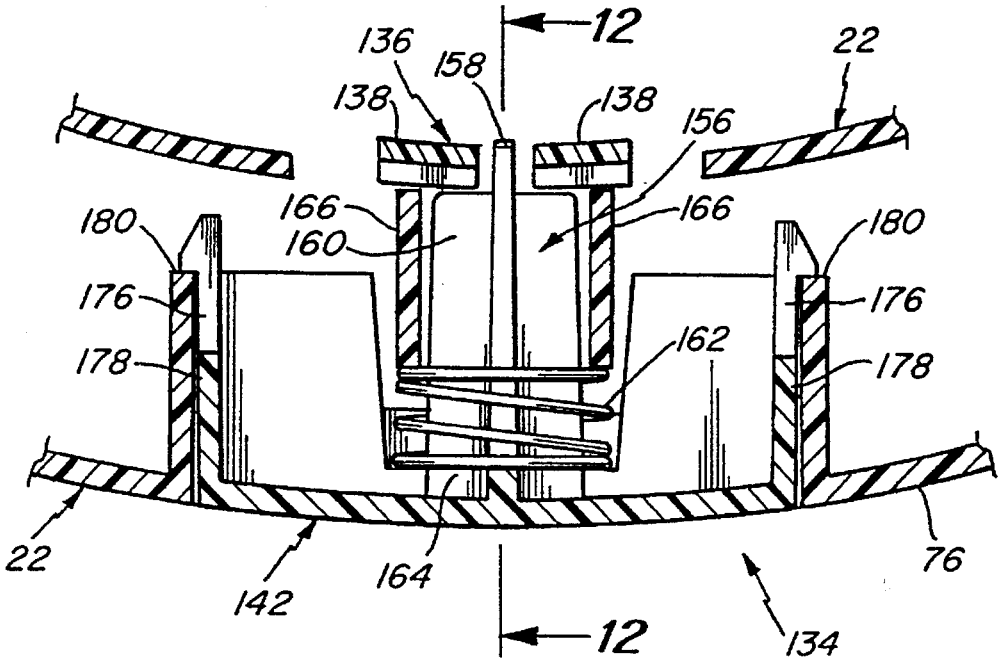
Figure 12:
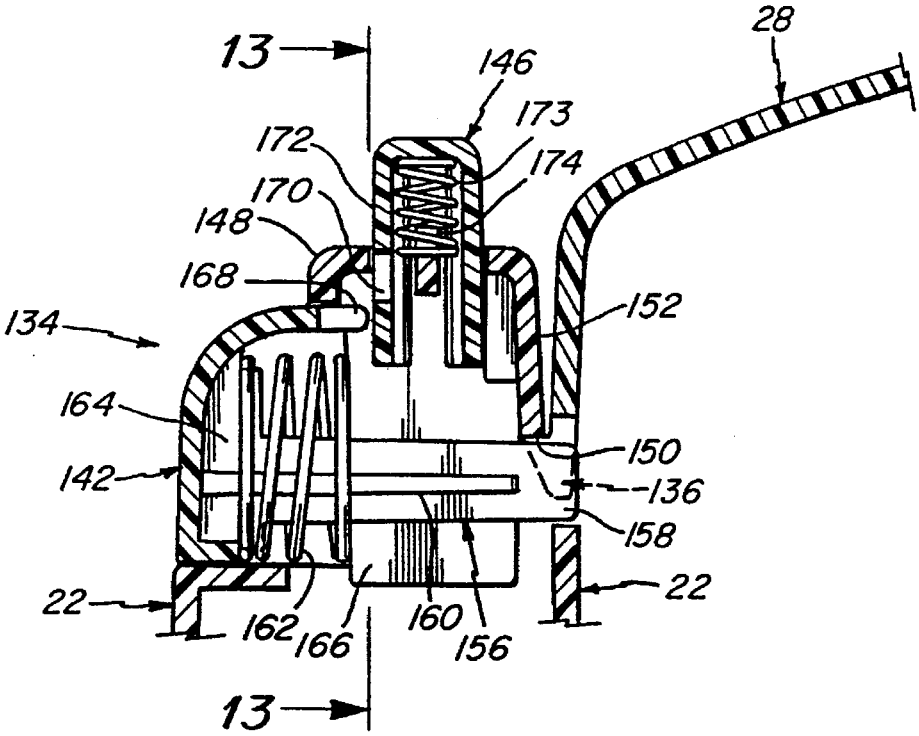
Figure 13:
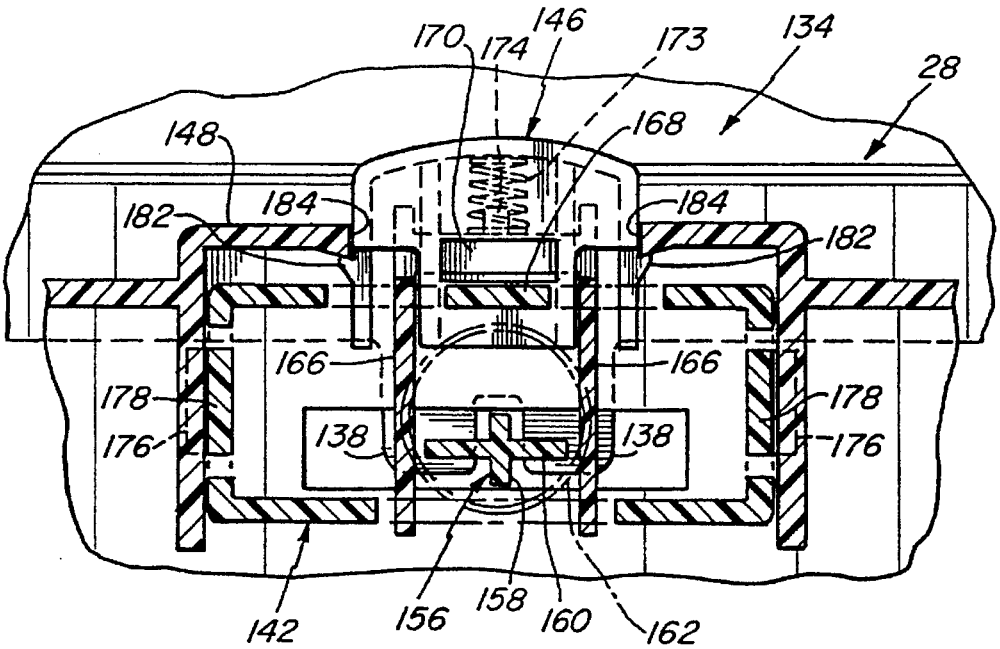
Figure 14:
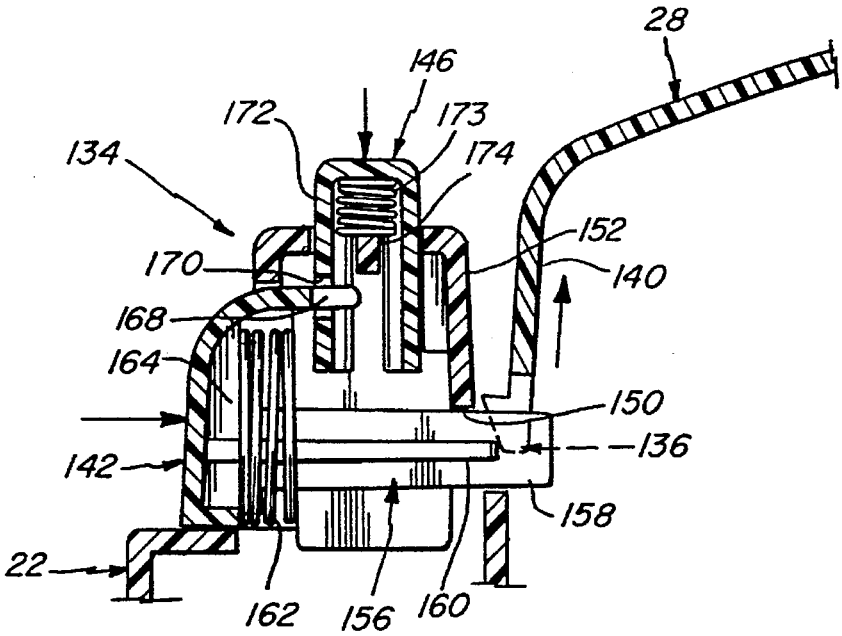
Figure 15:
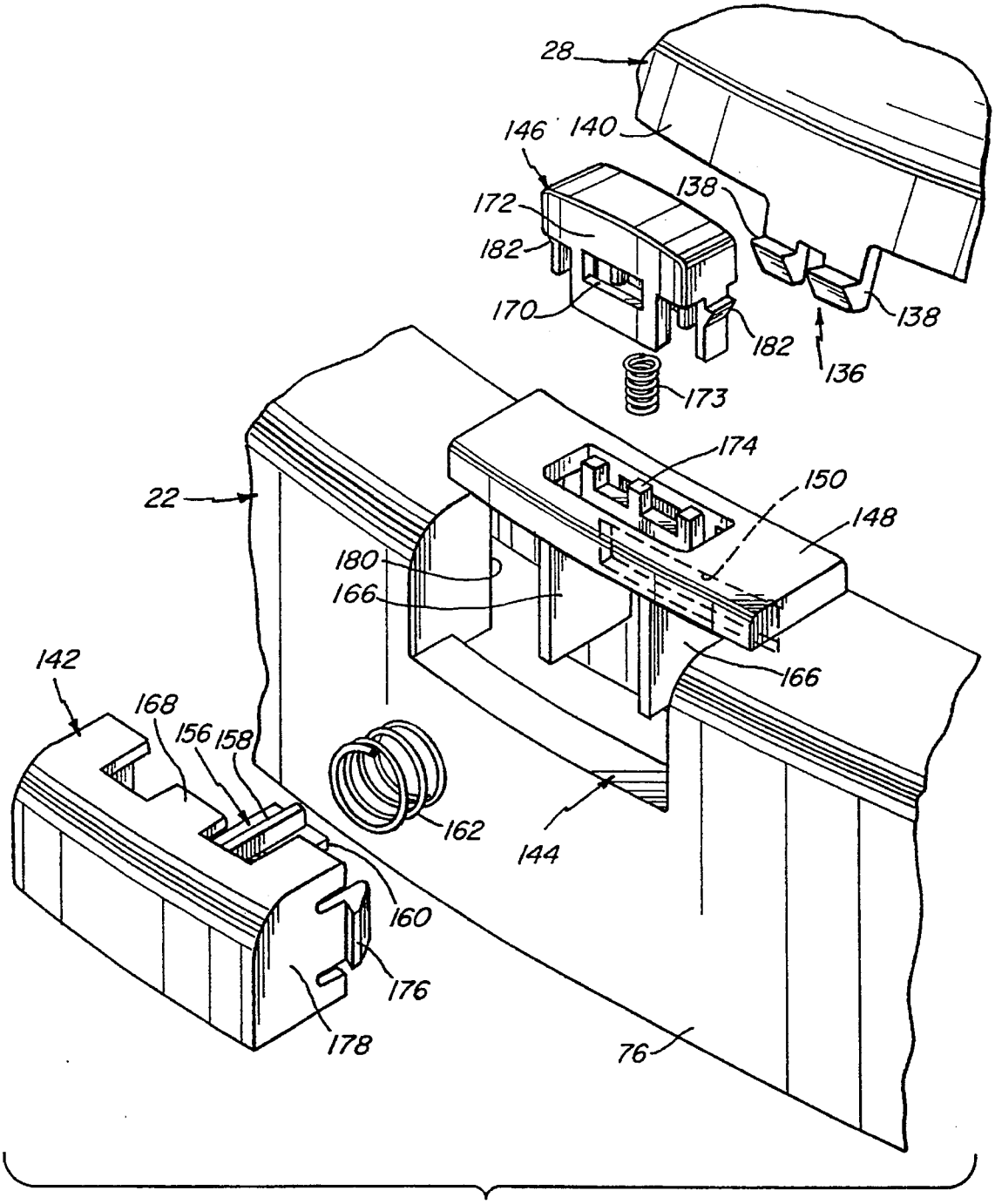
Figure 16:
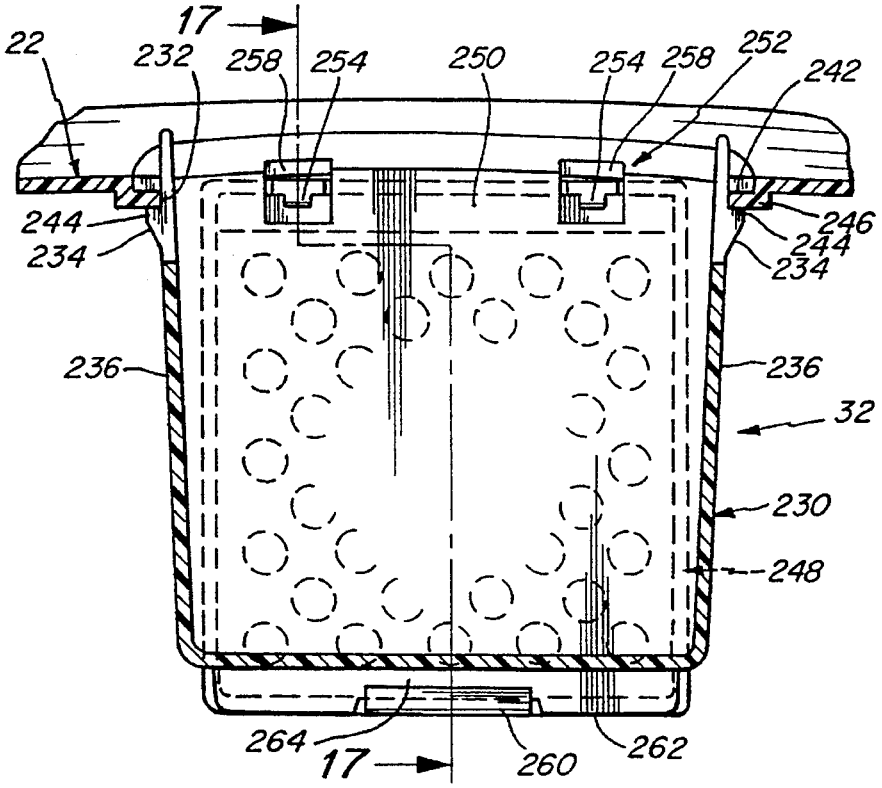
Figure 17:
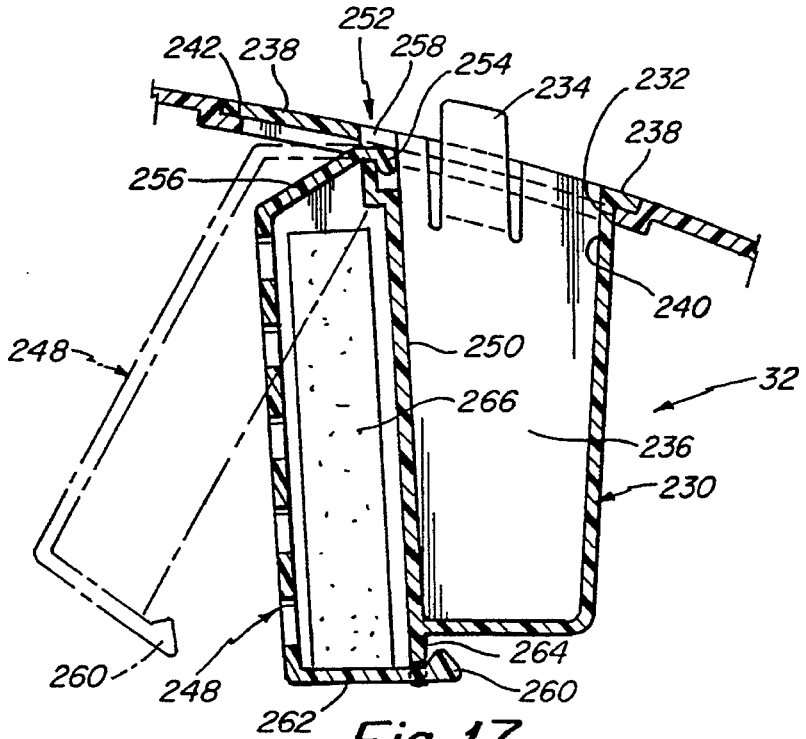

FIGS. 4 and 5 are fragmentary cross sectional views of the rim portion of the diaper pail taken along the section lines 4—4 and 5—5, respectively, in FIG. 3;

FIG. 6 is a fragmentary cross sectional view of the upper portion of the diaper pail taken along the section line 6—6 in FIG. 3 and showing in broken lines the inner and outer lids and cover in their open position and the handle basket assembly which houses the deodorant removed from the cover;

FIG. 7 is a fragmentary perspective view of the diaper pail with the cover in the open position and exposing the pail liner twisted closed and ready to be removed from the pail;

FIG. 8 is a fragmentary cross sectional view of the hinge of the outer lid taken along the section line 8—8 in FIG. 6;

FIG. 9 is a fragmentary cross sectional view of the outer lid hinge taken along the section line 9—9 in FIG. 8;

FIG. 10 is a fragmentary cross sectional view of the outer lid hinge taken along the section line 10—10 in FIG. 9;

FIGS. 11, 12 and 13 are fragmentary cross sectional views of the outer lid latch taken along section lines 11—11, 12—12 and 13—13, respectively, in FIGS. 6, 11 and 12;

FIG. 14 is a fragmentary cross sectional view similar to FIG. 12 but showing the latch in the unlocked condition;

FIG. 15 is an exploded perspective view of the latching mechanism for the outer lid;

FIG. 16 is a fragmentary cross sectional view of the deodorant basket taken along the section line 16—16 in FIG. 6; and FIG. 17 is a cross sectional view of the basket and cover handle taken along the section line 17—17 in FIG. 16.

DETAILED DESCRIPTION

The diaper pail assembly of the present invention includes several major parts including a pail 20, a cover 22 and a ring 24. In use the pail is lined with a conventional disposable trash bag 26, and the cover 22 and ring 24 cooperate to engage the top of the bag and twist it closed when the bag is full and before it is removed from the pail and its contents either laundered or disposed of, depending of course upon the type of diaper being used. The cover 22, in turn, carries an outer lid 28, inner lid 30 and handle deodorant basket assembly 32, all of which are described in detail below. The cover 22 is hinged to the ring 24 so that the two can turn together on the pail 20 to twist the trash bag closed.

The pail 20, molded of plastic or some similar material as are the other major parts of the assembly, is generally cylindrical although it has a slight upward draft for molding purposes. Flat areas 34 are provided on opposite sides shown in FIGS. 1 and 2 to accommodate the cover latches 36 and define handles on opposite sides of the pail so that it may easily be carried about.

Figure 2:
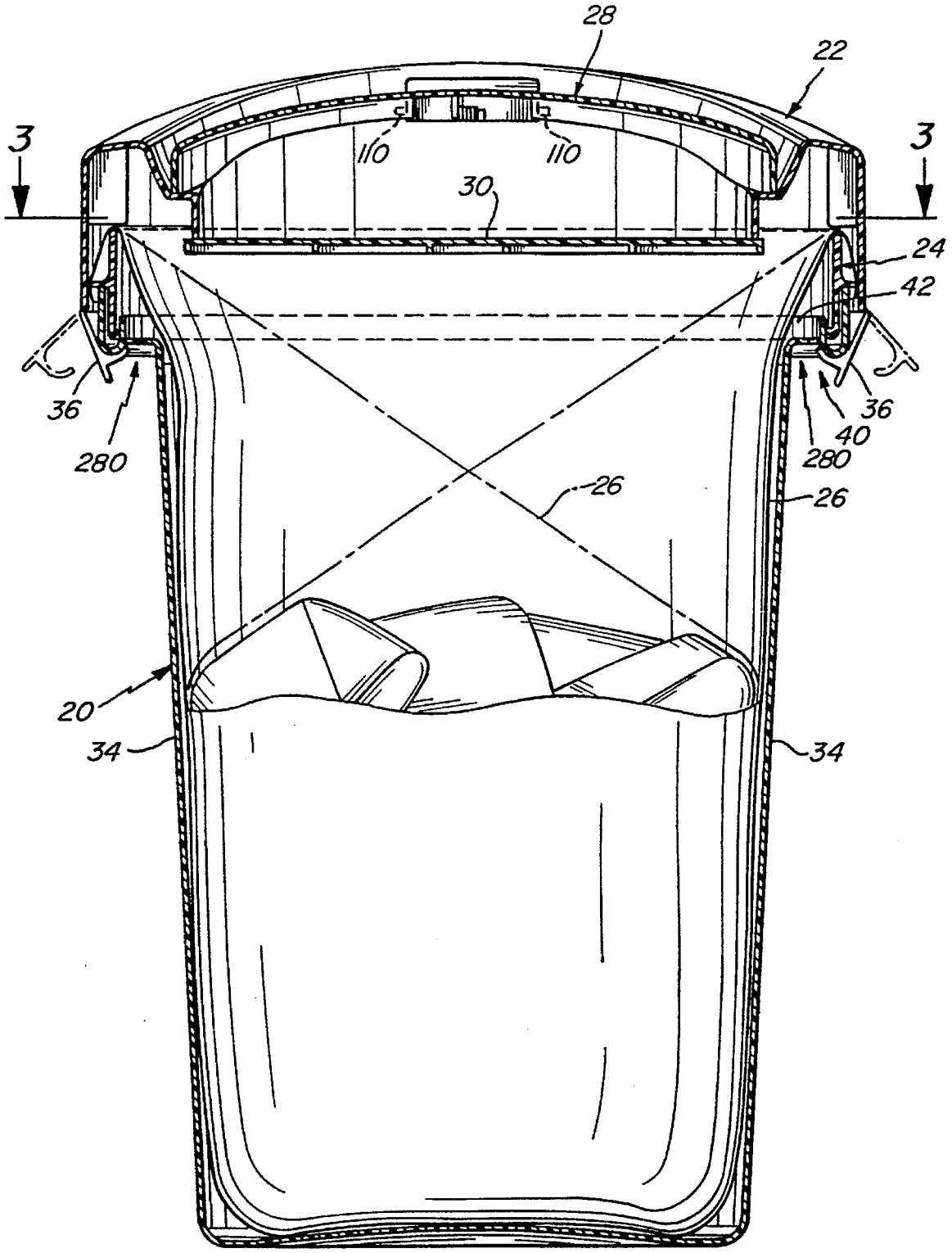
FIG. 2 is a cross sectional elevation view of the diaper pail taken along the section line 2—2 in FIG. 1.

A special rim structure 40 is provided about the mouth 42 of the pail to receive the ring 24 as is best illustrated in FIGS. 2, 4 and 5. The rim structure 40 includes an inner circular collar 44 and an outer circular collar 46 that are concentric with one another and are joined together at their lower ends to form a trough 48 about the pail mouth that houses the lower portion of the ring 24. The inner collar 44 carries at its top edge an outwardly extending barb 50 that engages the bottom of the ring 24 as is described more fully below.

Ring 24 is a continuous hoop carrying an outwardly extending horizontal flange 56 that rests on the top edge 58 of the outer collar 46 that serves as a bearing surface for the ring as it rotates on the pail 20. The lower edge of the ring 24 carries an inwardly extending lip 60 that snaps beneath the barb 50 on the inner collar 44 to retain the ring 24 assembled on the pail 20. Under normal conditions the ring is not intended to be removed from the pail. Ring 24 also carries hinge structure 64 (see FIGS. 3 and 6) including a hinge plate 66 having vertical parallel end flanges 68 that in turn carry outwardly extending pivot lugs 70 on which the cover 22 pivots.

Cover 22 includes a top wall 74 and depending skirt 76 attached to the periphery of the top wall. The skirt 76 surrounds the rim structure 40 of the pail 20 and the ring 24, and the skirt has a plurality of ribs 78 that extend inwardly over and engage the top of the ring and grip the top portion of the trash bag 26 so that rotation of the cover 22 and ring 24 will twist the top of the bag with them. Note the bag 26 in FIG. 7 twisted closed. On its outer surface, the cover skirt 76 has a hinge structure 80 that mates with the hinge structure 64 on the ring. The cover hinge structure 80 includes a hood 82 and side flanges 84 as shown in FIGS. 3, 6 and 7, with slots 86 in the flanges 84 that receive the hinge lugs 70. The lugs 70 and slots 86 allow the cover 22 to pivot from the closed position shown in full lines in FIG. 6 to the fully open position shown in FIG. 7. A stop 88 is disposed beneath the hinge plate 66 on the ring 24 and engages the edge 89 of the hood 82 when the cover is open so as to support the cover in that position. When the cover 22 is in the open position, the lugs 70 may be disengaged from the slots 86, and cover 22 can be removed from the pail and ring assembly for washing.

As indicated above, cover 22 carries inner and outer lids 28 and 30 that are independently hinged to the cover. The outer lid 28 is biased to the open position shown in broken lines in FIG. 6 while the inner lid 30 is biased to the closed position shown in solid lines in that figure. Each of the lids may be moved against the bias to the opposite position as is described in the following paragraphs. The lids 28 and 30 are disposed at the top and bottom respectively, of a vertical chute 100 formed as an integral part of the cover through which diapers are inserted in the pail 20. Chute 100 and lids 28 and 30 at its top and bottom are best illustrated in FIGS. 6 and 7.

Figure 1:
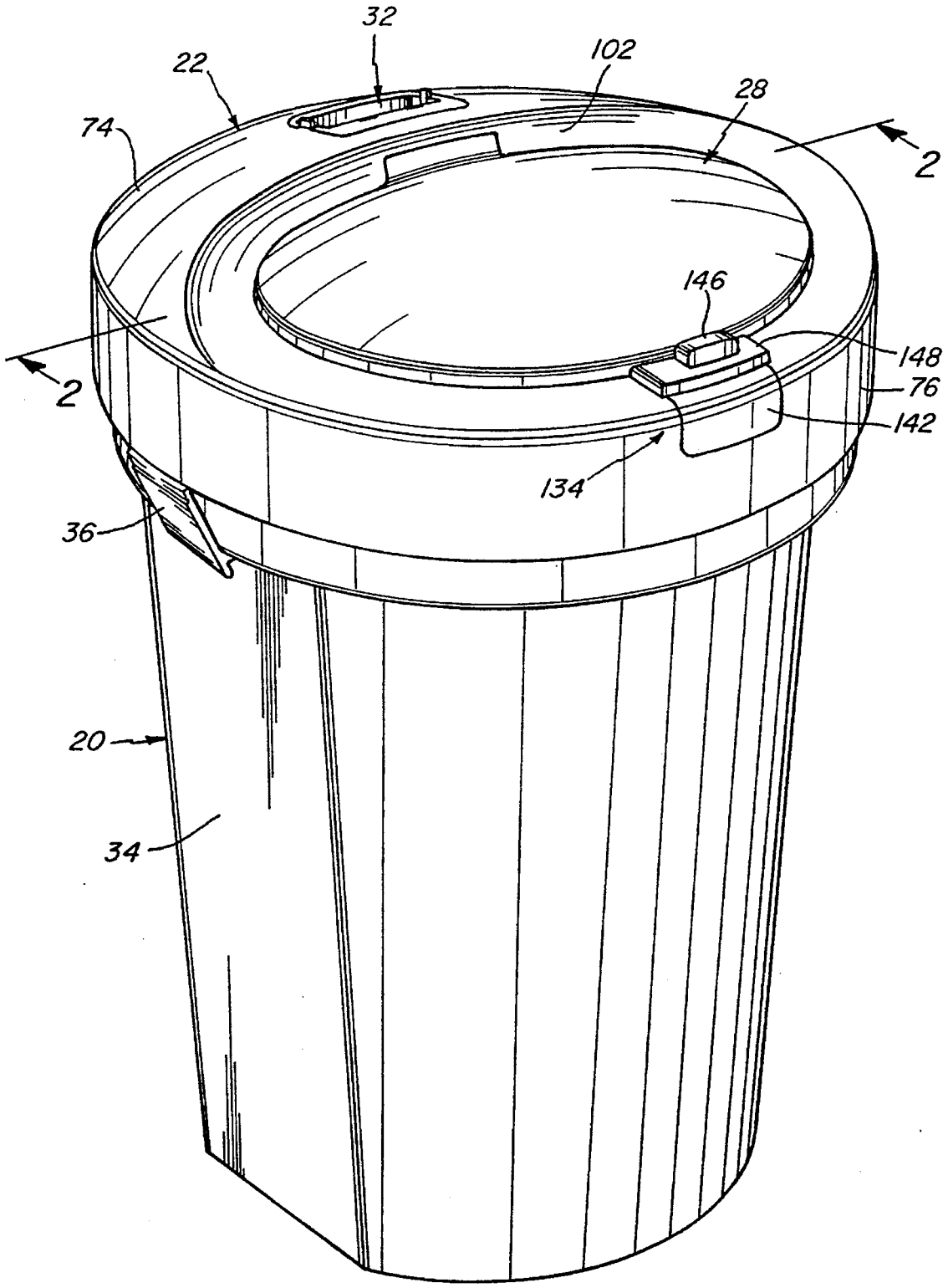
FIG. 1 is a perspective view of a diaper pail constructed in accordance with this invention.

In FIGS. 1, 6 and 9, the cover 22 is shown provided with a shoulder 102 on the side of the lid 28 nearer to the center of the cover 22 and just outside the vertical wall 104 of the chute. A pair of hinge plates 106 (see FIGS. 8 and 10) are carried by the cover 22 immediately adjacent to the chute wall 104. Lid 28 also carries a pair of hinge plates 108 that are disposed just inside the hinge plates 106 on the cover. The hinge plates 108 have hinge pins 110 that extend into slots 111 in the hinge plates 106 to permit the lid to swing between the open and closed positions. The outer lid 28 is biased to the open position by a torsion spring 112 that is mounted on a spring mounting lug 114 carried on the cover 22 between the hinge plates 106 (see FIGS. 8–10). The spring 112 is held on the lug 114 by retaining wall 115 on the inner surface of lid 28. One end 118 of spring 112 engages a reinforced rib 120 on the cover 22 so as to prevent the spring 112 from turning counterclockwise as viewed in FIG. 9 while the other end 122 of spring 112 bears against the lower surface of the portion of the outer lid 28 that lies between the hinge plates 108. Therefore the coiled portion 124 of the spring causes the spring end 122 to push upwardly on the cover causing it to pivot about the axis of the hinge lugs 110 and lift the lid 28 to the open position. Simply by pressing downwardly on the lid 28 it may be moved to the closed position.

A double latch lock and release assembly 134 for retaining the outer lid 28 in the closed position and releasing it to the action of the spring 112 is shown in detail in FIGS. 11–15. In the exploded view of FIG. 15 the various parts of the assembly 134 are most clearly shown. The lock latch assembly 134 operates on a catch 136 in the form of a pair of hook-like fingers 138 that depend from the skirt 140 of the outer lid 28. The latch lock assembly 134 and the catch 136 are disposed 180 degrees from, or opposite to the hinge structure that connects the cover 22 to the ring 24 as is evident in FIG. 6. A spring button 142 is mounted in a pocket 144 in the skirt 76 of the cover 22 for horizontal movement on the cover, and a spring lock 146 is mounted for vertical movement on the top wall 74 of the cover just above the spring button 142. A frame 148 on the cover top wall 74 supports the lock button 146.

FIGS. 12 and 14 show the latch lock assembly 134 in the latched and unlatched positions, respectively. In FIG. 12, the catch 136 on the lid 28 is shown disposed beneath the edge 150 of the depending wall 152 of the frame 148 so that the hook-like barbs on the fingers 138 are locked in place and the lid 28 cannot be raised. In FIG. 14 the catch 136 is shown released from beneath the edge 150 of the frame wall 152 and the lid is released so that it may move under the influence of the torsion spring 112. The catch 136 is pushed from beneath the edge 150 of the frame wall 152 by the horizontal star-shaped finger 156 carried by the spring button 142. It will be noted in FIGS. 11 and 14 that the finger has a vertical fin 158 that extends between the two fingers 138 of the catch 136 to maintain the catch and finger 156 in alignment with one another while the horizontal flanges 160 of the spring button finger 156 bear against the bottom of the catch fingers 138 so that they can push the catch 136 to the right as viewed in FIGS. 12 and 14 to displace the catch 136 from beneath the edge 150. The spring button 142 is biased to the withdrawn or inactive position of FIG. 12 by compression spring 162 that is disposed between the inner end 164 of the finger 156 and the ribs 166 on the frame 148.

Spring button 142 carries a prong 168 that extends toward the lock button 146 and is aligned with an opening 170 in the skirt 172 of the button (see FIGS. 12, 14 and 15). When the lock button 146 is in the raised position of FIG. 12, the opening 170 is not aligned with the prong 168, and the spring button 142 cannot be depressed to release the catch 136 from the edge 150 of the frame 148. However, when the lock button is depressed as in FIG. 14, the prong 168 and opening 170 are in alignment and the spring button can be depressed to release the catch 136. The lock button 146 is biased to the raised position of FIG. 12 by compression spring 173 that is supported on post 174 on the frame 148 and bears against the under side of the button.

The spring button 142 carries snaps 176 on its side walls 178 (see FIG. 15) that lie beyond the inner edges 180 of the pocket 144 so that the button 142 cannot be pushed from the pocket 144 by spring 162, and similarly, the lock button 146 carries snaps 182 that lie beneath the edges 184 of the frame 148 to prevent the spring 172 from pushing the button out of the frame.

As shown in FIGS. 3, 6 and 7, the wall 104 of the chute 100 has an extension 190 that carries a hinge structure 192 that supports the lower lid 30 at the bottom of the chute. The hinge structure 192 is very similar to the hinge structure that carries the upper lid 28 and need not again be described. A torsion spring 194 urges the inner lid 30 to the closed position shown in full lines in FIG. 6 by virtue of the positions of the ends 196 of the torsion spring 194 bearing against the bottom of the inner lid and the extension 190. The inner lid 30 may be opened simply by pushing downwardly upon it to overcome the bias of the spring 194.

It is apparent from the foregoing that to deposit a soiled diaper in the pail 20, the latch lock 142 must be opened to cause the upper lid 28 to rise and the lower lid must be pushed downwardly, so as to open the chute 100. After depositing the diaper in the pail through chute 100, the inner lid 30 is released causing it to close, and the upper lid 28 must be pushed down against the bias of the spring 112 so as to cause the catch 136 to engage the edge 150 of the frame wall 152. The manipulation of the latch lock assembly 134 to release the catch 136 cannot readily be performed by a toddler and, therefore, the assembly affords protection against a young child's curiosity. In order to open the top lid 28 to gain access to the pail contents, the lock button 146 must first be depressed so as to align the opening 170 with the prong 168. With the lock button 146 held in the depressed position, the spring button must be pushed inwardly to cause the finger 156 to move the catch 136 from under the edge 150 of the frame wall 152. Only when the latch lock is operated in that fashion may the upper lid 28 be opened to afford access to the pail interior.

A handle and deodorant basket assembly 32 is mounted in the cover 22 and shown in FIGS. 3, 6, 7, 16 and 17. The assembly 32 includes a handle 230 removably retained in an opening 232 in the cover by means of a pair of snaps 234 on the end walls 236 of the handle 230. The handle 230 also has a flange 238 about its upper edge 240 that sits in a shallow recess 242 about the opening 232 in the cover. The handle 230 may be removed simply by squeezing the two snaps 234 toward one another so as to free their barbs 244 from beneath the shelf 246 that defines the recess 242. This is evident from an inspection of FIG. 16. The assembly 32 also includes a basket 248 that is hinged to the top of the handle wall 250 as shown in FIG. 17. The basket hinge 252 is defined by a bead 254 on the top wall 256 of the basket, which wall extends through a slot 258 in the handle. A snap 260 is provided on the bottom wall 262 of the basket 248, which engages a flange 264 on the bottom of the handle 230 to retain the basket in the closed position shown in full lines in FIG. 17. The basket 248 may be opened to the position shown in broken lines by releasing the snap 260. In FIG. 17 a deodorant bar 266 is shown disposed in the basket, and it is to be understood that any type of deodorant may be used. The basket 248 in the embodiment shown is perforated. To refill the basket 248, the handle and basket assembly 32 is withdrawn from the cover 22 as suggested in broken lines in FIG. 6 (without opening the cover), and after the assembly 32 is removed, the basket is opened, the deodorant is inserted, the basket is then closed, and the assembly is snapped into place in the cover.

To ready the diaper pail assembly of this invention for use, the cover 22 is opened and a trash bag 26 is inserted in the pail 20 with the edge of the trash bag overlapping the ring 24 as shown in FIGS. 2 and 7. The cover 22 is then closed, and the lids 28 and 30 are also closed. (The inner lid 30 is biased to the closed position while the outer lid 28 must be pushed to the closed position so that the latch lock 134 will engage the catch 136). In addition, a deodorant bar should be placed in the basket 248 in the manner described above. To dispose of a soiled diaper, the diaper is usually first rolled into a ball by the person disposing of it. Next the person disposing of the diaper must open the upper lid 28 by pressing the lock button 146 and while doing so pressing the spring button 142 to release the upper lid 28 and allow it to rise to the open position. With the lid 28 open the user merely places the balled diaper in the chute 100 and pushes it down upon the inner cover 30, which causes the inner cover to open and allows the diaper to fall into the trash bag 26. When the person wants to dispose of the trash bag liner with one or more soiled diapers in it, he or she simply turns the cover 22 and ring 24 on the rim of the pail 20, and this action twists the bag 26 closed as shown in FIG. 7. The twisted closed bag 26 may be removed from the pail by releasing the latches 36 that are attached to the lower edge of the cover skirt 76. The latches 36 are sufficiently flexible so as to enable the user to pull the hooked portions of the latches off the bottom wall of the channel 48 in the rim of the pail 20. Freed in that fashion, the cover then may be pivoted to the open position on the hinge structure that connects the cover 22 to the ring 24, as suggested in FIG. 7 and a twist tie 271 may be used to permanently close the bag. The bag 26 of soiled diapers may then be removed from the pail and a new liner 26 may be inserted and the cover closed so that the diaper pail assembly is again ready for use.

Having described this invention in detail, those skilled in the art will appreciate the many advantages of the diaper disposal system made available by the present invention. It is extremely easy to use, the assembly can be carried about by means of the handles 280 formed at the tops of the flat areas 34 in the pail 20 at the location of the cover latches 36 or by the handle 230 on the cover 22 when the cover latches 36 are locked, as shown in FIG. 1. As each diaper is deposited in the pail, the diaper is effectively sealed by virtue of the inner lid 30 being biased to the closed position. This sealing of the soiled diaper chamber is accomplished automatically without any manipulation on the part of the user. The trash bag 26 may be sealed readily simply by unlatching the cover latches 36 so as to allow the cover 22 and ring 24 to be turned on the rim 40 of the pail 20 as the cover and ring assembly rotates freely on the mouth of the pail. As another advantage of this invention, the latch lock assembly 134 that retains the upper lid 28 closed can not be operated by a toddler because of the special sequence of operations required and therefore the toddler cannot gain access to the soiled diapers in the pail 20. Even if the pail is turned on its side, the closed inner lid 30 and the locked outer lid 28 together with the toggle-like latches 36 that secure the cover 22 closed will not allow the contents of the pail to spill from it.

It will be apparent from the forgoing description that numerous modifications may be made of the invention without departing from its spirit. Therefore, it is not intended that the scope of this invention be limited to the specific embodiment illustrated and described. Rather, its scope is to be determined by the appended claims and their equivalents.

We claim:

1. A diaper pail assembly for receiving a trash bag liner having an open end which is to be twisted closed before removal, the diaper pail assembly comprising;

a pail including a side wall having a rim at a top portion thereof defining an opening for the pail for receiving a trash bag liner placed therein, a ring rotatably supported on the rim of the pail for rotation relative to the pail, said ring intended to support the open end of a trash bag liner disposed in the pail, and means for rotating the ring to twist the open end of the liner closed while the liner is in the pail.

2. A diaper pail assembly for receiving a trash bag liner which is to be twisted closed before removal, the diaper pail assembly comprising:

a pail including a rim at a top portion thereof to establish an opening for receiving a trash bag placed therein, a ring rotatably supported on the rim for rotation relative to the pail, said ring intended to support the top of trash bag liner disposed in the pail and for twisting the liner closed while the liner remains in the pail, and a lid pivotally mounted at the top of the pail for opening and closing the pail.

3. A diaper pail as defined in claim 2, wherein a rotator is connected to the ring and is carried on the pail for turning the ring to twist the liner closed.

4. A diaper pail as defined in claim 3, wherein the rotator is disposed outside the pail so that the liner can be twisted without opening the lid.

5. A diaper pail for receiving a liner which is to be twisted closed to enclose soiled diapers therein before removal, the diaper pail comprising:

a pail including a rim at a top portion thereof to define an opening for receiving a liner, a ring rotatable on the rim and over which the top of the liner extends above the rim when the liner is placed in the pail, and a rotator at the top portion of the pail and connected to the ring for turning the ring to twist the liner closed.

6. A diaper pail as defined in claim 5, wherein a lid is pivotally carried by the pail for providing access to the interior of the pail and liner to enable a diaper to be disposed of without removing the lid from the pail.

7. A diaper pail as defined in claim 6, wherein a latch is connected to the lid for releasably retaining the lid in the closed position.

8. A diaper pail as defined in claim 2, wherein a container is provided adjacent the open top portion of the pail for holding deodorant for the interior of the pail.

* * * * *